US006942520B2

(12) United States Patent
Barlian et al.

(10) Patent No.: US 6,942,520 B2
(45) Date of Patent: Sep. 13, 2005

(54) PLUG CONNECTION

(75) Inventors: Reinhold Barlian, Bad Mergentheim (DE); Thomas Michelbach, Lauda-Königshofen (DE); Hans-Martin Lösch, Würzburg (DE); Rainer Lang, Röttingen (DE)

(73) Assignee: Componenten und Systeme GmbH, Bad Mergentheim (DE)

( * ) Notice: Subject to any disclaimer, the term of this patent is extended or adjusted under 35 U.S.C. 154(b) by 0 days.

(21) Appl. No.: 10/119,521

(22) Filed: Apr. 9, 2002

(65) Prior Publication Data

US 2003/0190834 A1 Oct. 9, 2003

(30) Foreign Application Priority Data

Apr. 9, 2001 (DE) ..... 101 17 738

(51) Int. Cl.[7] ..... H01R 13/627
(52) U.S. Cl. ..... 439/548; 439/352; 439/559
(58) Field of Search ..... 439/350–4, 548, 439/551, 559, 569, 352, 353, 354, 351

(56) References Cited

U.S. PATENT DOCUMENTS

| | | | | | |
|---|---|---|---|---|---|
| 3,719,918 | A | * | 3/1973 | Kerr | 439/559 |
| 4,096,352 | A | * | 6/1978 | von Zweck | 439/559 |
| 4,545,633 | A | * | 10/1985 | McGeary | 439/141 |
| 5,997,333 | A | * | 12/1999 | Konda et al. | 439/352 |
| 6,227,895 | B1 | * | 5/2001 | Mc Farlane | 439/352 |
| 6,476,520 | B1 | * | 11/2002 | Bohm et al. | 439/950 |

FOREIGN PATENT DOCUMENTS

| | | |
|---|---|---|
| DE | 4205960 C2 | 5/1993 |
| DE | 19851725 C1 | 9/2000 |
| EP | 0 981 185 A2 | 2/2000 |
| EP | 1085615 A1 | 3/2001 |

* cited by examiner

*Primary Examiner*—Renee Luebke
(74) *Attorney, Agent, or Firm*—Horst M. Kasper

(57) ABSTRACT

A plug connection for a line with a tubular shaped metal bush and an also tubular shaped plug part wherein a metal sleeve of the plug part is supported in the metal bush and wherein at least one snap in hook of the plug part engages into a catch recess of the metal bush in the coupling state.

40 Claims, 2 Drawing Sheets

PLUG CONNECTION

The invention relates to a plug connection for a line, in particular a bus line for energy and/or data transfer.

It is an object of the invention to provide plug connection, which plug connection accomplishes an easy coupling independent of position and without auxiliary agents with highly reliable functioning capability even in case of high mechanical loads.

These and other objects and advantages of the present invention will become evident from the description which follows.

BRIEF DESCRIPTION OF THE INVENTION

The present invention provides a plug connection for a line, in particular for a bus line, for energy and/or data transfer. The tubular shaped metal bush and an also tubular shaped plug part with an inner metal sleeve, a casing jacket gripping around the metal sleeve and an outer actuating ring are employed, wherein a support tube part of the metal sleeve is free of play supported in the coupling state in a guide part of the metal bush and at least one snap in hook of the casing jacket engages into a catch recess of the metal bush, wherein the snap in hook is disengageable by shifting of the actuating ring.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention:

FIG. 1: a tube shaped plug part in a sectional enlarged representation,

DESCRIPTION OF INVENTION AND PREFERRED EMBODIMENT

Figure 1:
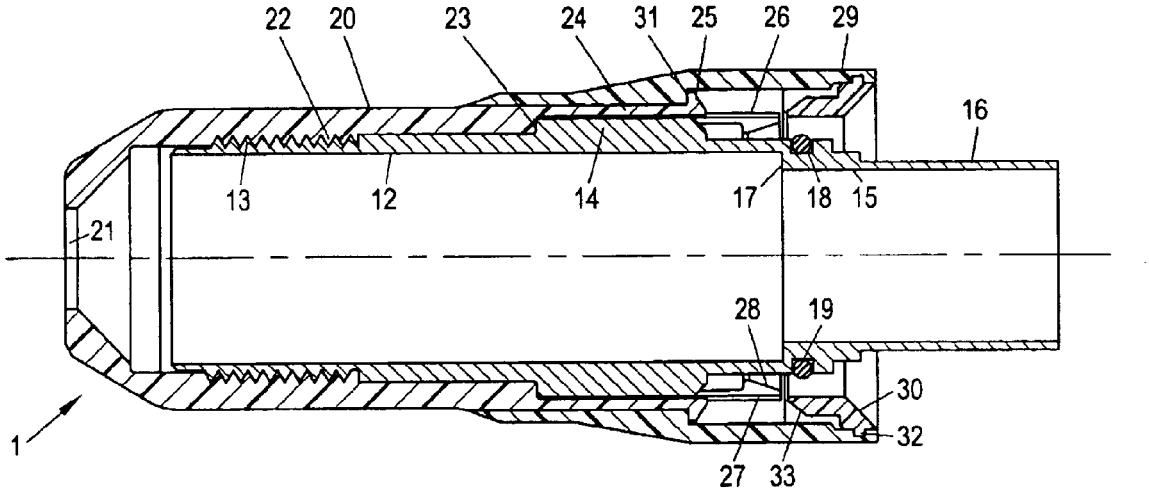
FIG. 1 is a view
Figure 2:
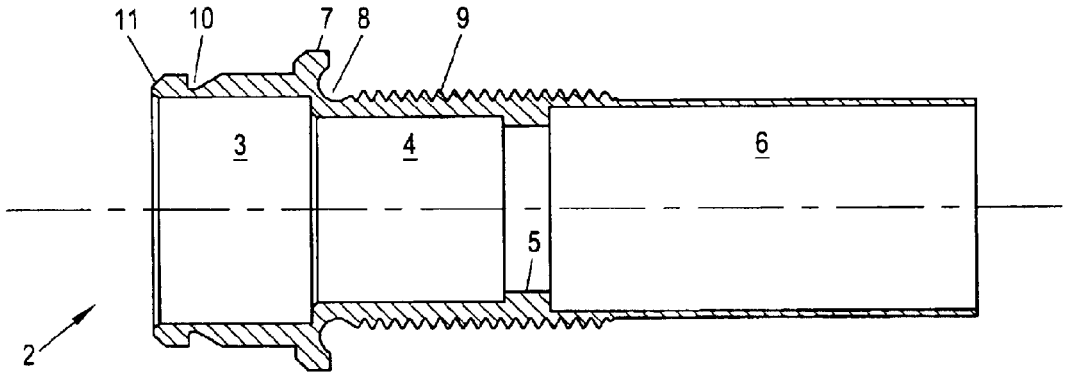
FIG. 2: a metal bush in a sectional enlarged representation.

The plug connection according to the present invention exhibits a tube shaped plug part 1 and an also tube shaped metal bush 2, which form the plug connection casing. The metal bush 2 exhibits a receiver part 3 in axial direction, wherein the diameter of the receiver part 3 is larger than a following guide part 4. The guide part 4 is delimited at the end disposed relatively remote to the receiver part 3 by a ring shaped web 5, wherein the inner diameter of the web 5 is smaller than the inner diameter of the guide part 4. The tubular piece 6 follows to the web 5, wherein the inner diameter of the tubular piece 6 is larger than the inner diameter of the ring shaped web 5 and wherein the axial length of the tubular piece 6 can be about equal to the length of the receiver part 3, of the guide part 4 and of the ring shaped web 5.

In addition, the metal bush 2 exhibits on the outside a ring shaped stop collar 7, wherein the stop collar 7 can be furnished about in the region between the end of the receiver part 3 and the beginning of the guide part 4 and wherein the stop collar 7 is furnished with a preferably trough shaped receiver 8 on the side disposed remote to the receiver part 3, wherein a seal not illustrated here can be positioned in the trough shaped receiver 8. An outer thread 9 follows this receiver 8, wherein the outer thread 9 can extend over the guide part 4 and the ring shaped web 5 and to the tubular piece 6.

Advantageously, the metal bush 2 can be spatially fixedly mounted at a wall of a distributor or transmitter casing not illustrated here by inserting the tubular piece 6 from the outside through a hole or, respectively, threaded hole formed in the wall into the casing until the stop collar 7 with the seal comes to rest at the outer face of the casing wall. Then a threaded nut not illustrated here is screwed to such extent on the outer thread 9 that the seal is correspondingly deformed and the stop collar 7 firmly rests at the casing wall such that a sealing connection is furnished. The largest part of the metal bush 2 thus is disposed in the distributor casing or in the transmitter casing and only the stop collar 7 with the seal and the receiver part 3 protrude beyond the casing outer wall.

In addition, a catch recess 10 is formed in the tubular wall of the receiver part 3, wherein the catch recess 10 can be preferably formed as a ring groove having a wedge shaped cross-section. It can be advantageous for this purpose to chamfer the free end of the tubular shaped wall of the receiver part 3 such that a leading ramp 11 is formed.

The plug part 1 is furnished with an inner metal sleeve 12 having an outer thread 13, wherein the outer thread 13 is formed at the one end region of the metal sleeve 12. A collar 14 formed somewhat larger in diameter can be finished about in the middle of the metal sleeve 12, and a bearing part 15 and a support tube part 16 follow axially to the collar 14. It can be recognize from the drawing that the inner diameter of the support tube part 16 and of the bearing part 15 is smaller as compared with the inner diameter of the remaining part of the metal sleeve 12, such that a stop 17 is formed about in the middle of the bearing part 15. The outer diameter of the bearing part 15 advantageously can be larger than the outer diameter of the support tube part 16. In addition, it can be advantageous to form a ring shaped groove 18 open toward the outside in the tubular wall of the bearing part 15, wherein a sealing ring 19 can be supported such in the groove 18 that the sealing ring 19 somewhat protrudes beyond the outer circumference of the bearing part 15.

In addition, it is to be noted that the outer diameter of the support tube part 16 of the metal sleeve 12 is smaller as compared to the inner diameter of the guide part 4 formed in the metal bush 2 and the outer diameter of the bearing part 15 of the metal sleeve 12 is equal to or only slightly smaller as compared with the inner diameter of the receiver part 3 of the metal bush 2.

The metal sleeve 12 of the plug part 1 is enveloped by a casing jacket 20, wherein the casing jacket 20 is preferably produced from a plastic material resistant to impact and exhibits a conically narrowed end part with the passage bore hole 21 for the line not illustrated here. The casing jacket 20 is furnished with an inner thread 22, wherein the metal sleeve 12 with the thread 13 is screwed into the inner thread 22 so far that the collar 14 rests at the shoulder 23 of the casing jacket 20.

The casing jacket 20 can exhibit at least one, and preferably four catch hooks 24 formed at the casing jacket 20 of the same material and arranged at equal distances distributed over the circumference. The catch hooks 24 extend from the shoulder 23 over the collar 14 and are furnished with a hook part 25 protrudingly radially toward the outside. In addition, the casing jacket 20 is furnished with at least one and preferably eight snap-in hooks 26 formed at the casing jacket 20 and made of uniform material, wherein advantageously two snap in hooks 26 can be combined closely spaced next to each other to a pair such that four snap in hook pairs are formed, wherein the four snap in hook pairs are disposed at the same distances at the circumference of the casing jacket 20. The snap in hooks 26 also extend from the shoulder 23 over the collar 14 of the metal sleeve 12 and are somewhat longer as compared with the catch hooks 24, wherein the catch hooks 24 advantageously are disposed within the distances between the snap in hook pairs. The radially inwardly directed hook 27 with a leading ramp 28 is formed at the free end of the snap in hook 26.

A sleeve shaped actuating ring 29 with a ring shaped debolting part 30 is supported at the casing jacket 20. The actuating ring 29 and the debolting part 30 can advantageously be made out of the same plastic material having impact strength as is made the casing jacket 20. The actuating ring 29 is slid so far onto the casing jacket 20 until the hook part 25 of the catch hook 24 locks snapping like and grips behind a counter support 31. The debolting part 30 is shape matching and captive held in a ring shaped recess of the actuating ring 29 with a peripheral nose 32 and exhibits a guiding inclination 33 disposed toward the sliding inclination 28 on the hook 27. It is further within the frame of the present invention to furnish the actuating ring 29 and the debolting part 30 as a single piece and of uniform material.

Figure 3:
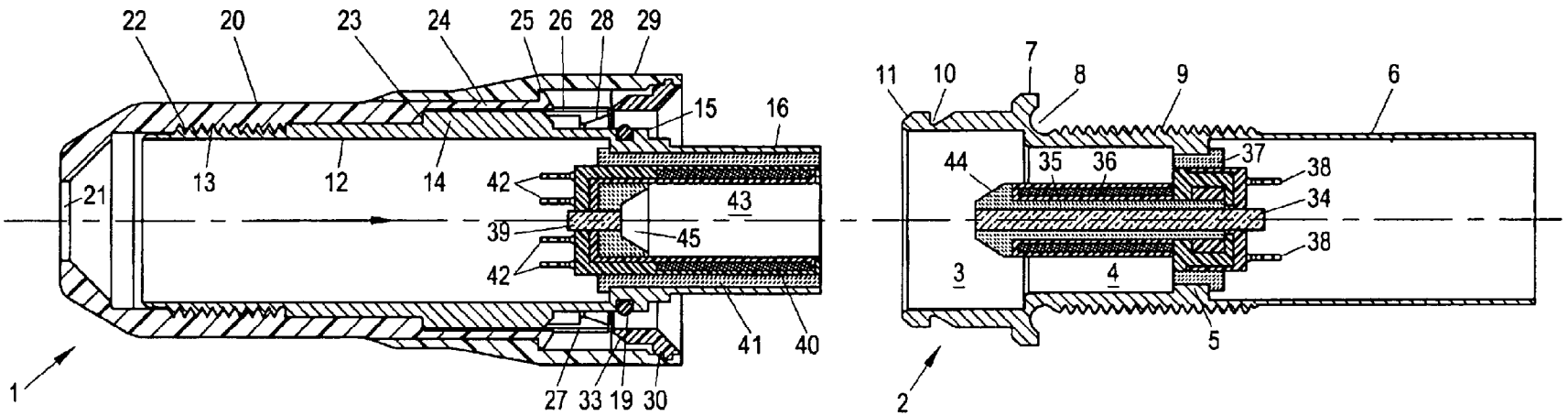
FIG. 3: the plug part and the metal bush of FIGS. 1 and 2 in a sectional, enlarged representation with integrated transfer parts.

It can be gathered from FIG. 3 that a light guiding rod 34 is disposed in the metal bush 2, wherein the light guiding rod 34 is surrounded by a ferrite core 35, wherein the ferrite core 35 supports an electric coil 36 and wherein a ferrite core closure ring 37 is furnished. In addition, connection contacts 38 are furnished, wherein the connection contacts are disposed in the region of the tubular piece 6. The ferrite closure ring 37 is supported in the ring shaped web 5 and the light guide rod 34, the ferrite core 35 and the electric coil 36 extend axially finger shaped through the guide part 4 up into the receiver part 3. A circuit board with electronic component parts and not illustrated here can be contacted with the connection contacts 38, wherein conductor strands can be connected to the circuit board, wherein the conductor strands can protrude out of the right side end of the tubular piece 6 shown in the drawing. The part of the tubular piece 6 can be sealingly cast with a casting resin according to the requirements of explosion protection.

It can be further gathered from FIG. 3 that a light conductor 39, a ring shaped electrical coil 40, a ferrite casing 41 surrounding the electrical coil 40 and conductor connections 42 are disposed in the metal sleeve 12 of the plug part 1. A circuit board equipped with electronic device components can be contacted at the conductor connectors 42, wherein also conductor strands can be connected at the circuit board, wherein in addition at least part of the metal sleeve 12 can be sealingly cast with a casting resin according to the requirements of explosion protection.

Upon coupling together of the plug connection according to the present invention, the plug part 1, as illustrated in FIG. 3, is placed coaxially in front of the metal bush 2 and axially transported in arrow direction, such that the support tube part 16 protrudes into the guide part 4 and such that the bearing part 15 is disposed substantially free of play in the receiver part 3, wherein the sealing ring 19 rests sealingly at the inner face of the bearing part 3. The slide-on inclination 28 of hook 27 is slid onto the roll on inclination 11 of the receiver part 3 whereby the snap in hooks 26 are initially bent radially toward the outside. As soon as the plug part 1 has been inserted into the metal bush 2 up to the stop, the snap in hooks 26 move based on their spring elastic restoration force again radially inwardly, such that the hooks 27 engage into the ring shaped catch recess 10, whereby the plug part 1 locks with the metal bush 2 and the coupling process is finished. The light conductor rod 34, the ferrite core 35, and the electric coil 36 are disposed in the chamber 43 co-bordered by the coil 40 in this coupling state and the conical front part 44 of the ferrite core 35 is supported in the receiver funnel 45 following to the light conductor 39 such that the light conductor rod 34 and the light conductor 39 align exactly coaxially.

The plug part 1 is gripped with one hand during decoupling of the plug connection and the actuating ring 29 is shifted axially to some extent (about 2 mm) in the direction toward the conically narrowed end parts of the casing jacket 20. The de-bolting part 30 thereby grips under the hook 27 and the slide on inclination 28 passes onto the guiding inclination 33, whereby the snap in hook 26 is necessarily pressed radially outwardly against the spring elastic restoring force, such that the hook 27 is taken out of the catch recess 10. The plug connection is thereby de-bolting and the plug part 1 can be separated easygoing against the direction of the arrow from the metal bush 2. After the decoupling and the releasing of the actuating ring 29, then the actuating ring 29 is slid back automatically into the starting position based on the spring elastic restoring force of the snap in hooks 26.

Overall the plug connection according to the present invention can be coupled and decoupled exclusively with a hand independent of position and without auxiliary agents, wherein the preferred embodiment of the plug connection is pressure resistant encapsulated in the sense of the explosion protection or in increased safety or is formed as a cast capsule or is formed self safe. The snap in connection assures a safe and nevertheless easily disengageable coupling connection and a comparatively light and nevertheless very reliable plug connection is given, which connection exhibits a high functioning capability even under rough operating conditions and under large impact loads, based on the high impact strength of the metal bush 2 with the integrated stop collar 7 and the metal sleeve 12 as well as with the stable casing jacket 20 and the actuating ring 29, which casing jacket 20 and actuating ring 29 are made out of an impact resistant plastic. The high safety against outer impact loads is in particular also reached or, respectively, favored by having the outer diameter of the bearing part 15 substantially free of play supported in the inner diameter of the receiver part 3 of the metal bush 2 with a fitting.

It will be understood that each of the elements described above, or two or more together, may also find a useful application in other types of cable system configurations and connecting procedures differing from the types described above.

While the invention has been illustrated and described as embodied in the context of a plug connection, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A plug connection for a bus line for energy and/or data transfer, comprising a tubular shaped metal bush having a guide part and a catch recess;

a tubular shaped plug part having an inner metal sleeve;

a casing jacket gripping around the metal sleeve;

an outer actuating ring disposed on the tubular shaped plug part and slidable on an outside of the casing jacket in an axial direction relative to the casing jacket;

a support tube part for the metal sleeve supported free of play in the coupling state in the guide part of the metal bush;

a snap in hook of the casing jacket engaging into the catch recess of the metal bush, wherein the snap in hook is disengageable by shifting of the outer actuating ring.

2. The plug connection according to claim 1 further comprising a bearing part of the metal sleeve, wherein the metal bush includes a receiver part predisposed to the guide part for engaging of the bearing put of the metal sleeve, wherein the bearing part is disposed adjacent to the support tube part and wherein the inner diameter of the receiver part is equal to or only slightly larger than the outer diameter of the bearing part; and wherein an outer diameter of the support tube part of the metal sleeve is smaller than the inner diameter of the guide part of the metal bush.

3. The plug connection according to claim 1 further comprising a receiver part, wherein the inner diameter of the receiver part is larger than the inner diameter of the guide pat of metal bush; and a bearing part of the metal sleeve, wherein the outer diameter of the bearing part of the metal sleeve is larger than the outer diameter of the support tube part.

4. The plug connection according to claim 1 further comprising a receiver part of the metal bush;

wherein the metal bush includes an outer thread and a stop collar with a receiver for a seal, wherein the stop collar of the metal bush is disposed in a region between the receiver part and the guide part and wherein the outer thread is furnished at a side of the stop collar disposed opposite to the receiver.

5. The plug connection according to claim 1 further comprising a tube piece forming part of the metal bush, wherein the metal bush has the tube piece neighboring the guide part and wherein a ring shaped web is formed in between the guide part and the tube piece, and wherein the catch recess is disposed in the wall of the receiver part of the metal bush and is formed as a ring groove and wherein a roll on inclination for a snap in hook is disposed in front of the catch recess.

6. The plug connection according to claim 1 wherein the actuating ring adjoins a de-bolting part gripping under the snap in hook, wherein the snap in hook includes a sliding inclination and wherein the sliding inclination corresponds to a guide inclination of the de-bolting part.

7. The plug connection according to claim 6 further comprising a plurality of snap in hooks;

a plurality of catch hooks, wherein the plurality of snap in hooks is formed as pairs and wherein four snap in hook pairs are furnished distributed at the circumference of the casing jacket;

wherein the plurality of catch hooks are shorter than the plurality of snap in hooks and wherein the catch hooks are disposed at distances between two snap in hook pairs for each catch hook;

wherein the casing jacket together with the catch hooks and the snap in hooks as well as the actuating ring with the de-bolting part are produced out of an impact resistant plastic.

8. The plug connection according to claim 1 wherein the plug connection is a pressure tight encapsulated connection for an explosion protection or formed with increased safety as a cast capsule; and wherein the plug connection is formed safe in itself for the explosion protection.

9. A plug connection for a bus line for energy and/or data transfer, comprising a receiver part (3) having a tubular wall, a front end and a rear end, a guide part (4) having a front end attached to the rear end of the receiver part (3), and a catch recess (10) formed in an outer side of the tubular wall of the receiver part (3), wherein the receiver past (3), the guide part (4) and the catch recess (10) form a tubular shaped metal bush (2);

an inner metal sleeve (12) having a front end and having a rear end, a casing jacket (20) gripping around the metal sleeve (12), a support tube part (16) for supporting the metal sleeve (12) and having a front end and having a rear end, wherein the rear end of the support tube part (16) is attached to the front end of the inner metal sleeve (12), a snap in hook (26) formed in the casing jacket (20), wherein the inner metal sleeve (12), the casing jacket (20), the support tube part (16) and the snap in hook (26) form a tubular shaped plug part (1);

wherein the support tube part (16) is supported free of play in a coupling state in the guide part (4) of the metal bush (2);

wherein the snap in hook (26) engages with the catch recess (10) of the metal bush (2), a bearing part (15) of the metal sleeve (12);

a sealing ring (19) furnished between the bearing part (15) of the metal sleeve (12) and the receiver part (3) of the metal bush (2), wherein the sealing ring (19) is supported in a groove (18) of the bearing part (15);

wherein the metal bush (2) includes a tube piece (6) disposed behind the guide part (4) and wherein a ring shaped web (5) is formed in between the guide part (4) and the tube piece (6); and wherein the catch recess (10) disposed in the wall of the receiver part (3) of the metal bush (2) is formed as a ring groove and wherein a roll on inclination (11) for a snap in hook (26) is disposed in front of the catch recess (10).

10. A plug connection for a bus line for energy and/or data transfer comprising a tubular shaped metal bush having a guide part and a catch recess;

a tubular shaped plug part having an inner metal sleeve;

a casing jacket gripping around the metal sleeve;

an outer actuating ring disposed on the tubular shaped plug part;

a support tube part for the metal sleeve supported free of play in the coupling state in the guide part of the metal bush;

a snap in hook of the casing jacket engaging into the catch recess of the metal bush, wherein the snap in hook is disengageable by shifting of the outer actuating ring;

a collar having a shoulder and disposed at the metal sleeve, wherein the metal sleeve of the plug part has a thread formed on an end region disposed remote relative to the support tube part, wherein the thread is screwable into an inner thread of the casing jacket;

and wherein the casing jacket is supported by the shoulder at the collar of the metal sleeve;

a catch hook disposed at the casing jacket, wherein the catch hook is located at the circumference of the casing jacket, wherein the catch hook grips behind a counter support of the actuating ring.

11. A plug connection for a bus line for energy and/or data transfer comprising a tubular shaped metal bush having a guide part and a catch recess;

a tubular shaped plug part having an inner metal sleeve;

a casing jacket gripping around the metal sleeve;

an outer actuating ring disposed on the tubular shaped plug part;

a support tube part for the metal sleeve supported free of play in the coupling state in the guide part of the metal bush;

a snap in hook of the casing jacket engaging into the catch recess of the metal bush, wherein the snap in hook is disengageable by shifting of the outer actuating ring;

a light conductor;

an electrical coil;

conductor connectors; and a ferrite casing, wherein the light conductor, the electrical coil, the conductor connectors, and the ferrite casing are disposed in the metal sleeve of the plug part and a light conductor rod, a ferrite core surrounding the light guide rod, an electrical coil surrounding the ferrite core, connection contacts, and a ferrite closure ring are disposed in the metal bush;

wherein the light conductor, the coil, and the ferrite casing are furnished in the support tube part of the metal sleeve and wherein the light guide rod with the ferrite core and the electrical coil are furnished in the guide part of the metal bush;

wherein the ferrite closure ring is disposed in a ring shaped web of the metal bush;

wherein the light guide rod with the ferrite core and with the electric coil is formed like fingers and engages a cylindrical chamber delimited by the coil and the ferrite casing.

12. A plug connection for a bus line, for energy and/or data transfer, comprising a tubular shaped metal bush (2) and an also tubular shaped plug part (1) with at inner metal sleeve (12), a casing jacket (20) gripping around the inner metal sleeve (12) and an outer actuating ring (29) disposed on the tubular shaped plug part, wherein a support tube part (16) of the inner metal sleeve (12) is supported free of play in a coupling state in a guide part (4) of the metal bush (2) and at least one snap in hook (26) of the casing jacket (20) engages into a catch recess (10) of the metal bush (2), wherein the snap in hook (26) is disengageable from the catch recess (10) by shifting of the actuating ring (29);

wherein a light conductor (39), an electrical coil (40), conductor connectors (42), and a ferrite casing (41) are disposed in the metal sleeve (12) of the plug part (1) and a light conductor rod (34), a ferrite core (35) surrounding the light guide rod (34), an electrical coil (36) surrounding the ferrite core (35), connection contacts (38), and a ferrite closure ring (37) are disposed in the metal bush (2).

13. The plug connection according to claim 12, wherein the metal bush (2) includes a receiver part (3) disposed in front of the guide part (4) for engaging of a bearing part (15) of the inner metal sleeve (12), wherein the bearing part (15) is disposed behind the support tube part (16) and wherein an inner diameter of the receiver part (3) is equal to or only slightly larger than an outer diameter of a bearing part (15); and wherein an outer diameter of the support tube part (16) of the inner metal sleeve (12) is smaller than an inner diameter of the guide part (4) of the metal bush (2).

14. The plug connection according to claim 12 wherein an inner diameter of a receiver part (3) is larger than an inner diameter of the guide part (4) of the metal bush (2); and wherein an outer diameter of a bearing part (15) of the metal sleeve (12) is larger than an outer diameter of a support tube part (16).

15. The plug connection according to claim 12 wherein the metal bush (2) includes an outer thread (9) and a stop collar (7) with a receiver (8) for a seal; and wherein the stop collar (7) of the metal bush (2) is disposed in the region between the receiver part (3) and the guide part (4) and wherein the outer thread (9) is furnished at the side of the stop collar (7) disposed opposite to the receiver (8).

16. The plug connection according to claim 12 wherein the plug connection is a pressure tight encapsulated connection for an explosion protection or formed with increased safety as a cast capsule; and wherein the plug connection is formed safe in itself and constructed for the explosion protection.

17. A plug connection for a bus line, for energy and/or data transfer, comprising a tubular shaped metal bush (2) and an also tubular shaped plug part (1) with an inner metal sleeve (12), a casing jacket (20) gripping around the inner metal sleeve (12) and an outer actuating ring (29) disposed on the tubular shaped plug part (1), wherein a support tube part (16) of the metal sleeve (12) is supported free of play in a coupling state in a guide part (4) of the metal bush (2) and at least one snap in hook (26) of the casing jacket (20) engages into a catch recess (10) of the metal bush (2), wherein the snap in hook (26) is disengageable from the catch recess by shifting of the actuating ring (29), wherein a sealing ring (19) is furnished between a bearing part (15) of the metal sleeve (12) and a receiver part (3) of the metal bush (2), and wherein the sealing ring (19) is supported in a groove (18) of the bearing part (15) or of the receiver part (3).

18. A plug connection for a bus line, for energy and/or data transfer, comprising a tubular shaped metal bush (2) an also tubular shaped plug part (1) with an inner metal sleeve (12), a casing jacket (20) gripping around the inner metal sleeve (12) and an outer actuating ring (29) disposed on the tubular shaped plug part, wherein a support tube part (16) of the inner metal sleeve (12) is supported free of play in a coupling state in a guide part (4) of the metal bush (2) and at least one snap in hook (26) of the casing jacket (20) engages into a catch recess (10) of the metal bush (2), wherein the snap in hook (26) is disengageable from the catch recess (10) by shifting of the actuating ring (29);

wherein the metal bush (2) includes a tube piece (6) disposed behind the guide part (4) and wherein a ring shaped web (5) is formed in between the guide part (4) and the tube piece (6); and wherein the catch recess (10) disposed in the wall of the receiver part (3) of the metal bush (2) is formed as a ring groove and wherein a roll on inclination (11) for the snap in hook (26) is disposed in front of the catch recess (10).

19. A plug connection for a bus line, for energy and/or data transfer, comprising a tubular shaped metal bush (2) and an also tubular shaped plug part (1) with an inner metal sleeve (12), a casing jacket (20) gripping around the inner metal sleeve (12) and an outer actuating ring (29) disposed on the tubular shaped plug part, wherein a support tube part (16) of the inner metal sleeve (12) is supported free of play in a coupling state in a guide part (4) of the metal bush (2) and at least one snap in hook (26) of the casing jacket (20) engages into a catch recess (10) of the metal bush (2), wherein the snap in hook (26) is disengageable from the catch recess (10) by shifting of the actuating ring (29), wherein the inner metal sleeve (12) of the plug part (1), having a thread (13) formed at the end region disposed remote to the support tube part (16), is screwable into an inner thread (22) of the casing jacket (20);

wherein the casing jacket (20) is supported with a shoulder (23) at a collar (14) of the metal sleeve (12); and wherein the casing jacket (20) exhibits four catch hooks (24) distributed at the circumference, wherein each catch hook (24) grips behind a counter support (31) of the actuating ring (29).

20. A plug connection for a bus line, for energy and/or data transfer, comprising a tubular shaped metal bush (2) and an also tubular shaped plug part (1) with an inner metal sleeve (12), a casing jacket (20) gripping around the inner metal sleeve (12) and an outer actuating ring (29) disposed on the tubular shaped plug part, wherein a support tube part (16) of the inner metal sleeve (12) is supported free of play in a coupling state in a guide part (4) of the metal bush (2) and at least one snap in hook (26) of the casing jacket (20) engages into a catch recess (10) of the metal bush (2), wherein the snap in hook (26) is disengageable from the catch recess (10) by shifting of the actuating ring (29);

wherein the actuating ring (29) includes a debolting part (30) gripping under the snap in hook (26), wherein the snap in hook (26) is ring shaped;

wherein the snap in hook (26) includes a sliding inclination (28) and wherein the sliding inclination corresponds to a guide inclination (33) of the de-bolting part (30);

wherein the snap in hook (26) is formed as pairs and wherein snap in hook pairs are finished distributed at the circumference of the casing jacket (20);

wherein catch hooks (24) are shorter than the snap in hooks (26) and are disposed at distances between two snap in hook pairs for each catch hook (24); and wherein the casing jacket (20) together with the catch hooks (24) and the snap in hooks (26) as well as the actuating ring (29) with the de-bolting part (30) are produced out of an impact resistant plastic.

21. A plug connection for a bus line, for energy and/or data transfer, comprising a tubular shaped metal bush (2) and an also tubular shaped plug part (1) with an inner metal sleeve (12), a casing jacket (20) gripping around the inner metal sleeve (12) and an outer actuating ring (29) disposed on the tubular shaped plug part, wherein a support tube part (16) of the inner metal sleeve (12) is supported free of play in a coupling state in a guide part (4) of the metal bush (2) and at least one snap in hook (26) of the casing jacket (20) engages into a catch recess (10) of the metal bush (2), wherein the snap in hook (26) is disengageable from the catch recess by shifting of the actuating ring (29), wherein a light conductor (39), an electrical coil (40), conductor connectors (42), and a ferrite casing (41) are disposed in the metal sleeve (12) of the plug part (1) and a light conductor rod (34), a ferrite core (35) surrounding the light guide rod (34), an electrical coil (36) surrounding the ferrite core (35), connection contacts (38), and a ferrite closure ring (37) are disposed in the metal bush (2);

wherein the light conductor (39), the coil (40), and the ferrite casing (41) are furnished in the support tube part (16) of the metal sleeve (12) and wherein the light guide rod (34) with the ferrite core (35) and the electrical coil (36) are furnished in the guide part (4) of the metal bush (2);

wherein the ferrite closure ring (37) is disposed in the ring shaped web (5) of the metal bush (2); and wherein the light guide rod (34) with the ferrite core (35) and with the electric coil (36) is formed like fingers and engages a cylindrical chamber (43) delimited by the coil (40) and the ferrite casing (41).

22. A plug connection for a bus line for energy and/or data transfer comprising a tubular shaped metal bush having a guide part and a catch recess;

a tubular shaped plug part having an inner metal sleeve;

a casing jacket gripping around the metal sleeve;

an outer actuating ring disposed on the tubular shaped plug part;

a support tube part for the metal sleeve supported free of play in the coupling state in the guide part of the metal bush;

a snap in hook of the casing jacket engaging into the catch recess of the metal bush, wherein the snap in hook is disengageable by shifting of the outer actuating ring;

a bearing part of the metal sleeve;

a receiver part of the metal bush;

a sealing ring furnished between the bearing part of the metal sleeve and the receiver part of the metal bush, wherein the sealing ring is supported in a groove of the bearing part or of the receiver part.

23. The plug connection according to claim 22 wherein an outer diameter of the bearing part is larger than an outer diameter of the support tube part, wherein the groove is open toward an outside and disposed in a tubular wall of the bearing part, wherein the sealing ring is supported in the groove such that the sealing ring protrudes beyond an outer circumference of the bearing part.

24. A plug connection for a bus line, for energy and/or data transfer, comprising a tubular shaped metal bush (2), an inner metal sleeve (12), a casing jacket (20) gripping around the metal sleeve (12), wherein the casing jacket (20) is engaged on the metal sleeve (12) from a side opposite to the metal bush (2), an outer actuating ring (29), wherein the outer actuating ring (29) is engaged on the casing jacket (20) from a side opposite to the metal bush (2), wherein the inner metal sleeve (12), the casing jacket (20), the metal sleeve and the outer actuating ring (29) form a tubular shaped plug part (1), wherein a support tube part (16) of the metal sleeve (12) is free of play supported in the coupling state in a guide part (4) of the metal bush (2) and wherein the metal sleeve (12) is located inside the metal bush (2) in the coupling state when the metal bush (2) is engaged to the plug part (1), and at least one snap in hook (26) of the casing jacket (20) engages into a catch recess (10) of the metal bush (2), wherein the snap in hook (26) is disengageable from the catch recess (10) by shifting of the actuating ring (29) directly by hand, wherein an outer diameter of the metal sleeve (12) is less than an inner diameter of the casing jacket (20) along of the whole length of the metal sleeve (12);

wherein a light conductor (39), an electrical coil (40), conductor connectors (42), and a ferrite casing (41) are disposed in the metal sleeve (12) of the plug part (1) and a light conductor rod (34), a ferrite core (35) surrounding the light guide rod (34), an electrical coil (36) surrounding the ferrite core (35), connection contacts (38), and a ferrite closure ring (37) are disposed in the metal bush (2).

25. A plug connection for a bus line for energy and/or data transfer, comprising a receiver part (3) having a tubular wall, a front end and a rear end, a guide part (4) having a front end attached to the rear end of the receiver part (3), and a catch recess (10) formed in an outer side of the tubular wall of the receiver part (3), wherein the receiver part (3), the guide part (4) and the catch recess (10) form a tubular shaped metal bush (2);

an inner metal sleeve (12) having a front end and having a rear end, a casing jacket (20) gripping around the metal sleeve (12), an outer actuating ring (29) disposed on the casing jacket (20) and capable of assuming a locking position and a released position, wherein the outer actuating ring (29) is disposed in the released position by sliding toward the front end of the inner metal sleeve (12), and wherein the outer actuating ring (29) is disposed in the locking position by sliding toward the rear end of the inner metal sleeve (12), a support tube part (16) for supporting the metal sleeve (12) and having a front end and having a rear end, wherein the rear end of the support tube part (16) is attached to the front end of the inner metal sleeve (12), a snap in hook (26) formed in the casing jacket (20), wherein the snap in hook (26) is bendable radially toward an outside while the outer actuating ring (29) is disposed in the released position, and wherein the snap in hook (26) has a straight shaft and is not bent radially toward the outside while the outer actuating ring (29) is disposed in the locking position, wherein the inner metal sleeve (12), the casing jacket (20), the outer actuating ring (29), the support tube part (16) and the snap in hook (26) form a tubular shaped plug part (1);

wherein the support tube part (16) is supported free of play in a coupling state in the guide part (4) of the metal bush (2);

wherein the snap in hook (26) engages with the catch recess (10) of the metal bush (2) and wherein the snap in hook (26) is locked by the outer actuating ring (29) shifting into the locking position, wherein the snap in hook (26) is disengageable from the catch recess (10) by shifting of the outer actuating ring (29) into the released position.

26. The plug connection according to claim 25 wherein a light conductor (39), an electrical coil (40), conductor connectors (42), and a ferrite casing (41) are disposed in the metal sleeve (12) of the plug part (1) and a light conductor rod (34), a ferrite core (35) surrounding the light guide rod (34), an electrical coil (36) surrounding the ferrite core (35), connection contacts (38), and a ferrite closure ring (37) are disposed in the metal bush (2).

27. The plug connection according to claim 25 wherein the front end of the support tube part (16) is protruding beyond the front end of the inner metal sleeve (12).

28. The plug connection according to claim 25 wherein the catch recess (10) is formed on the outer side of the tubular wall of the receiver part (3), wherein the catch recess (10) is formed as a ring groove having a wedge shaped cross-section, wherein a free end of the tubular shaped wall of the receiver part (3) is chamfered for forming a leading ramp (11).

29. The plug connection according to claim 25 further comprising a bearing part (15) attached to the metal sleeve (12), wherein the receiver part (3) is disposed in front of the guide part (4) for engaging of the bearing part (15), wherein the bearing part (15) is disposed behind the support tube part (16) and wherein the inner diameter of the receiver part (3) is equal to or slightly larger than the outer diameter of the bearing part (15); and wherein an outer diameter of the support tube part (16) of the metal sleeve (12) is smaller than an inner diameter of the guide part (4) of the metal bush (2).

30. The plug connection according to claim 25 wherein an inner diameter of the receiver part (3) is larger than an inner diameter of the guide part (4) of metal bush (2); and further comprising a bearing part (15) of the metal sleeve (12), wherein an outer diameter of the bearing part (15) of the metal sleeve (12) is larger than an outer diameter of the support tube part (16).

31. The plug connection according to claim 25 further comprising a bearing part (15) of the metal sleeve (12);

a sealing ring (19) disposed between the bearing part (15) of the metal sleeve (12) and the receiver part (3) of the metal bush (2), wherein the sealing ring (19) is supported in a groove (18) of the bearing part (15) or of the receiver part (3).

32. The plug connection according to claim 25 wherein the metal bush (2) includes an outer thread (9) and a stop collar (7) with a receiver (8) for a seal, wherein the stop collar (7) of the metal bush (2) is disposed in a region between the receiver part (3) and the guide part (4) and wherein the outer thread (9) is furnished at a side of a stop collar (7) disposed opposite to the receiver (8).

33. The plug connection according to claim 25 further comprising a tube piece (6) disposed at the metal bush (2), wherein the metal bush (2) includes the tube piece (6) disposed behind the guide part (4) and wherein a ring shaped web (5) is formed in between the guide part (4) and the tube piece (6), and wherein the catch recess (10) is disposed in the tubular wall of the receiver part (3) of the metal bush (2) and is formed as a ring groove and wherein a roll-on inclination (11) for a snap in hook (26) is disposed in front of the catch recess (10).

34. The plug connection according to claim 25 further comprising a collar (14) having a shoulder (23) and disposed at the metal sleeve (12), wherein the metal sleeve (12) of the plug part (1) has a thread (13) formed at an end region disposed remote relative to the support tube part (16), wherein the thread (13) is screwable into an inner thread (22) of the casing jacket (20);

and wherein the casing jacket (20) is supported by the shoulder (23) at the collar (14) of the metal sleeve (12);

a catch hook (24) disposed on the casing jacket (20), wherein the casing jacket (20) has the catch hook (24) at a circumference, wherein the catch hook (24) grips behind a counter support (31) of the outer actuating ring (29).

35. The plug connection according to claim 25 wherein the outer actuating ring (29) adjoins a de-bolting part (30) gripping under the snap in hook (26);

wherein the snap in hook (26) includes a sliding inclination (28) and wherein the sliding inclinator (28) corresponds to a guide inclination (33) of the de-bolting part (30).

36. The plug connection according to claim 35 further comprising a plurality of snap in hooks (26), a plurality of catch hooks (24), wherein the plurality of map in hooks (26) is formed as pairs and wherein four snap in hook (26) pairs are furnished distributed at the circumference of the casing jacket (20);

wherein the plurality of catch hooks (24) is shorter than the plurality of snap in hooks (26) and wherein the catch hooks (24) are disposed at distances between two snap in hook (26) pairs for each catch hook (24);

wherein the casing jacket (20) together with the catch hooks (24) and the snap in hooks (26) as well as the outer actuating ring (29) with the de-bolting part (30) are produced out of an impact resistant plastic.

37. The plug connection according to claim 25 further comprising a light conductor (39);

an electrical coil (40);

conductor connectors (42); and a ferrite casing (41), wherein the light conductor (39), the electrical coil (40), the conductor connectors (42) and the ferrite casing (41) are disposed in the metal sleeve (12) of the plug pat (1) and a light guide rod (34), a ferrite core (35) surrounding the light guide rod (34), an electrical coil (40) surrounding the ferrite core (35), connection contacts (38), and a ferrite closure ring (37) are disposed in the metal bush (2);

wherein the light conductor (29), the coil (40), and the ferrite casing (41) are finished in the support tube part (16) of the metal sleeve (12) and wherein the light guide rod (34) with the ferrite core (35) and the electrical coil (36) are furnished in the guide part (4) of the metal bush (2);

wherein the ferrite closure ring (37) is disposed in a ring shaped web (5) of the metal bush (2);

wherein the light guide rod (34) with the ferrite core (35) and with the electric coil (36) is formed like fingers and engages a cylindrical chamber (43) delimited by the coil (40) and the ferrite casing (41).

38. The plug connection according to claim 25 wherein the plug connection is a pressure tight encapsulated connection for an explosion protection or formed with increased safety as a cast capsule; and wherein the plug connection is formed safe in itself and constructed for the explosion protection.

39. A plug connection for a bus line for energy and/or data transfer, comprising a receiver part (3) having a tubular wall, a front end and a rear end, a guide part (4) having a front end attached to the rear end of the receiver part (3), and a catch recess (10) formed in an outer side of the tubular wall of the receiver part (3), wherein the receiver part (3), the guide part (4) and the catch recess (10) form a tubular shaped metal bush (2);

an inner metal sleeve (12) having a front end and having a rear end, a casing jacket (20) gripping around the metal sleeve (12), a support tube part (16) for supporting the metal sleeve (12) and having a front end and having a rear end, wherein the rear end of the support tube part (16) is attached to the front end of the inner metal sleeve (12), a snap in hook (26) formed in the casing jacket (20), wherein the inner metal sleeve (12), the casing jacket (20), the support tube part (16) and the snap in hook (26) form a tubular shaped plug part (1);

wherein the support tube part (16) is supported free of play in a coupling state in the guide part (4) of the metal bush (2);

wherein the snap in hook (26) engages with the catch recess (10) of the metal bush (2), a collar (14) having a shoulder (23) and disposed at the metal sleeve (12), wherein the metal sleeve (12) of the plug part (1) has a thread (13) formed at an end region disposed remote relative to the support tube part (16), wherein the thread (13) is disposed screwable into an inner thread (22) of the casing jacket (20);

and wherein the casing jacket (20) is supported with the shoulder (23) at the collar (14) of the metal sleeve (12);

a catch hook (24) disposed at the casing jacket (20), wherein the casing jacket (20) includes the catch hook (24) at a circumference, wherein the catch hook (24) grips behind a counter support (31) of an actuating ring (29).

40. A plug connection for a bus line for energy and/or data transfer, comprising a receiver part (3) having a tubular wall, a front end and a rear end, a guide part (4) having a front end attached to the rear end of the receiver part (3), and a catch recess (10) formed in an outer side of the tubular wall of the receiver part (3), wherein the receiver part (3), the guide part (4) and the catch recess (10) form a tubular shaped metal bush (2);

an inner metal sleeve (12) having a front end and having a rear end, a casing jacket (20) gripping around the metal sleeve (12), a support tube part (16) for supporting the metal sleeve (12) and having a front end and having a rear end, wherein the rear end of the support tube part (16) is attached to the front end of the inner metal sleeve (12), a snap in hook (26) formed in the casing jacket (20), wherein the inner metal sleeve (12), the casing jacket (20), the support tube part (16) and the snap in hook (26) form a tubular shaped plug part (1);

wherein the support tube part (16) is supported free of play in a coupling state in the guide part (4) of the metal bush (2);

wherein the snap in hook (26) engages with the catch recess (10) of the metal bush (2);

a light conductor (39);

an electrical coil (40);

conductor connectors (42); and a ferrite casing (41), wherein the light conductor (39), the electrical coil (40), the conductor connectors (42) and the ferrite casing (41) are disposed in the metal sleeve (12) of the plug part (1) and a light guide rod (34), a ferrite core (35) surrounding the light guide rod (34), an electrical coil (40) surrounding the ferrite core (35), connection contacts (38), and a ferrite closure ring (37) are disposed in the metal bush (2);

wherein the light conductor (29), the coil (40), and the ferrite casing (41) are furnished in the support tube part (16) of the metal sleeve (12) and wherein the light guide rod (34) with the ferrite core (35) and the electrical coil (36) are furnished in the guide part (4) of the metal bush (2);

wherein the ferrite closure ring (37) is disposed in a ring shaped web (5) of the metal bush (2);

wherein the light guide rod (34) with the ferrite core (35) and with the electric coil (36) engages a cylindrical chamber (43) delimited by the coil (40) and the ferrite casing (41).

* * * * *